US006135835A

United States Patent [19]

Lekhtman

[11] Patent Number: 6,135,835

[45] Date of Patent: Oct. 24, 2000

[54] AQUATIC VEHICLE

[75] Inventor: David Lekhtman, Beaconsfield, Canada

[73] Assignee: Future Beach Corporation, Canada

[21] Appl. No.: 09/375,036

[22] Filed: Aug. 16, 1999

[51] Int. Cl.[7] ..... B63H 16/20; B63B 35/00; B63B 17/00

[52] U.S. Cl. ..... 441/31; 114/347; 114/363

[58] Field of Search ..... 440/21, 23, 26, 440/29, 31, 32; 114/347, 363

[56] References Cited

U.S. PATENT DOCUMENTS

| | | | |
|---|---|---|---|
| 4,676,755 | 6/1987 | Yagan | 440/26 |
| 4,795,381 | 1/1989 | Willems | 440/26 |
| 4,891,024 | 1/1990 | Benjamin | 440/28 |
| 4,943,251 | 7/1990 | Lerach et al. | 440/28 |
| 5,217,398 | 6/1993 | Meron et al. | 440/26 |
| 5,308,268 | 5/1994 | Schmid | 440/30 |

*Primary Examiner*—S. Joseph Morano
*Assistant Examiner*—Patrick Craig Muldoon
*Attorney, Agent, or Firm*—Mark Kusner

[57] ABSTRACT

The invention is directed to a peddle powered aquatic vehicle with a propeller driven by pedal cranks, a flywheel, and water-cooled belt drive transmission, the vehicle hull including T-bar steering handles, a saddle seat and lateral outriggers to enable a passenger to ride the vehicle like a bicycle on water. The aquatic vehicle has a buoyant hull with a central longitudinal body with the saddle seat allowing a passenger to be supported in a startling position. To provide lateral stability two elongate outriggers are disposed laterally from the central hull body with outrigger arms connecting the body to the outriggers. A manual steering mechanism is attached to the hull for steering by the passenger; preferably in the form of a T-bar journaled to the hull connected with cords to a rear mounted rudder. Pedal powered drive means are mounted in the hull for driving a stern mounted propeller. A pair of pedal cranks are journaled for rotation about the transverse axis. A longitudinal drive shaft with a propeller mounted on the rear end is connected to transmission means mounted on the forward end of the shaft for rotating the shaft in response to rotation of the pedal cranks. Within the hull of the vehicle is a hollow sump chamber within which the drive means are housed. Preferably, the transmission includes a fly wheel and drive belt providing gear reduction to a final drive mounted to the longitudinal shaft. The drive belt is twisted 90° between the flywheel and the final drive disc in order to provide very inexpensive gear reduction and transfer of direction from rotation about transverse axis to rotation about the longitudinal shaft axis. The sump is partially flooded with water from a water inlet and the drive mechanism is water cooled as water from the sump is splashed over moving parts. The propeller includes pivotally mounted blades which fold rearwardly to avoid damage when encountering obstacles or when the vehicle is dragged on the beach. Also, the folding of the propeller blades permits gliding of the vehicle on the water surfaces with reduced water resistance.

16 Claims, 8 Drawing Sheets

AQUATIC VEHICLE

TECHNICAL FIELD

The invention is directed to a peddle powered aquatic vehicle with a propeller driven by pedal cranks, a flywheel, and water-cooled belt drive transmission, wherein the vehicle hull includes T-bar steering handles, a saddle seat and lateral outriggers to enable a passenger to ride the vehicle in a manner similar to a bicycle over a water surface.

BACKGROUND OF THE ART

Recreational aquatic vehicles present several challenges to the designer. The cost of such vehicles must be extremely low in order to enable them to be commercial viable. In addition, recreational aquatic vehicles must be practically maintenance free and very simple to operate since they are used by a wide variety of people of different ages in often remote locations.

Preferably, recreational aquatic vehicles do not require external power and are powered either by peddling or rowing by the passengers. The present invention is directed specifically to a pedal powered aquatic vehicle. The muscles in the legs on a person are the largest muscle group and the human body is naturally inclined to provide maximum power through the action of the legs.

Conventional pedal powered aquatic vehicles utilize a pedal crank to drive a paddle wheel. Paddle wheels are very simple of construct and maintain, however, they are highly inefficient means of converting leg muscle power into forward propulsion of the aquatic vehicle. In addition, recreational paddle wheel aquatic vehicles generally are constructed with seats for two persons on either side of the paddle wheel. The paddle wheel boat is generally very wide and as result, such aquatic vehicles are difficult or awkward to operate if one person is seated in the vehicle. Paddle wheels can be mounted at the rear however the associated mechanism is generally considered to be excessively complex and heavy for recreational use.

Submerged propellers are more efficient than paddle wheels and are used almost exclusively in modern motorized nautical transport. To date however propellers have not been used for recreational non-motorized aquatic vehicles mainly since the associated mechanism is considered too complex and expensive for commercial viability.

It is an object of the present invention to provide a propeller driven pedal powered aquatic vehicle that can be produced inexpensively enough to render it practical for recreational use.

It is a further object of the invention to provide pedal powered drive means for an aquatic vehicle which can be inexpensively produced and are simple to maintain.

It is a further object of the invention to provide a pedal powered aquatic vehicle which can be ridden in a manner similar to a bicycle wherein the passenger straddles the vehicle and preferably experiences banking on a curved trajectory.

It is a further object of the invention to provide a propeller driven mechanism that is not subject to accidental damage during normally expected handling by unskilled operators.

Further objects of the invention will be apparent from review of the disclosure and description of the invention below.

DISCLOSURE OF THE INVENTION

The aquatic vehicle has a buoyant hull with a central longitudinal body with the saddle seat allowing a passenger to be supported in a straddling position. To provide lateral stability two elongate outriggers are disposed laterally from the central hull body with outrigger arms connecting the body to the outriggers. A manual steering mechanism is attached to the hull for steering by the passenger; preferably in the form of a T-bar journaled to the hull connected with cords to a rear mounted rudder.

Pedal powered drive means are mounted to the hull for driving a stern mounted propeller. A pair of pedal cranks are journaled for rotation about a transverse axis. A longitudinal drive shaft with a propeller mounted on the rear end is connected to transmission means mounted on the forward end of the shaft for rotating the shaft in response to rotation of the pedal cranks.

Within the hull of the vehicle is a hollow sump chamber within which the drive means are housed. Preferably, the transmission includes a flywheel and drive belt providing gear reduction to a final drive sprocket disc mounted to the longitudinal shaft. The drive belt is twisted between the flywheel and the final drive disc in order to provide very inexpensive gear reduction and transfer the direction from rotation about transverse axis to rotation about the longitudinal shaft axis.

The sump is partially flooded with water from a water inlet. Water floods into the sump when the craft with passenger float on the water at a level which submerges the inlet. The drive mechanism is water cooled as water from the sump is splashed over moving parts. Water and any sand or foreign particles are discharged from the sump through a sleeve about the propeller shaft through a drain opening adjacent the propeller.

The propeller includes a central hub and pivotally mounted blades which fold rearwardly to avoid damage when encountering obstacles or when the vehicle is dragged on the beach. The folding of the propeller blades also permits gliding of the vehicle on the water surfaces reducing water resistance.

Therefore, the invention provides significant advantages over prior art aquatic vehicles. The simplicity of the drive system enables the vehicle to be manufactured very cheaply of plastic moulded parts and can be maintained by relatively unskilled persons. The simple drive mechanism is not more complicated than a typical bicycle drive system, for example. The flywheel however provides the continuity of thrust required for continuously driving a propeller at high rotational speeds. The simple twisting of the drive belt eliminates the need for complex gear reduction mechanisms to increase the rotational speed and trasfer the orientation of rotation from transverse to axial which significantly adds to the cost, can be difficult to maintain and results in friction losses. The simple mechanism and housing can be constructed of relatively inexpensive plastic moulded components. Water-cooling is provided in order to maintain the operating temperature of such plastic components below a temperature where heat damage could occur.

The simple hull may be inexpensively made of plastic in a conventional blow moulding process. The steering mechanism and seat may also be formed of hollow blow moulded plastic shapes. The outriggers provide lateral stability required for a safe operation and permit the passenger to bank on curves providing a ride sensation similar to bicycle or motorcycle riding.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
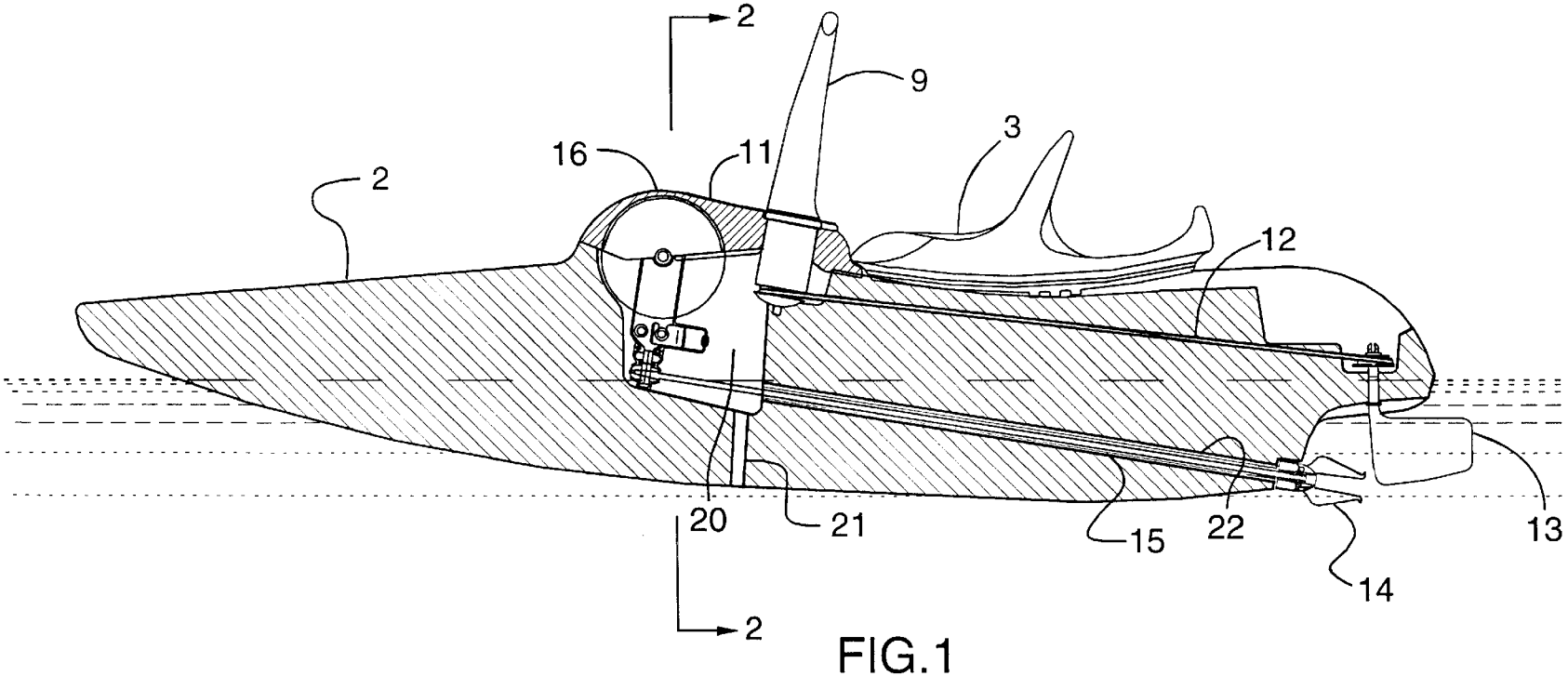
FIG. 1 is a longitudinal cross-sectional view through the aquatic vehicle showing the saddle seat, a T-bar steering column and a forward sump within which is housed with a pedal powered drive mechanism, a longitudinal drive shaft and folding propeller.
Figure 2:
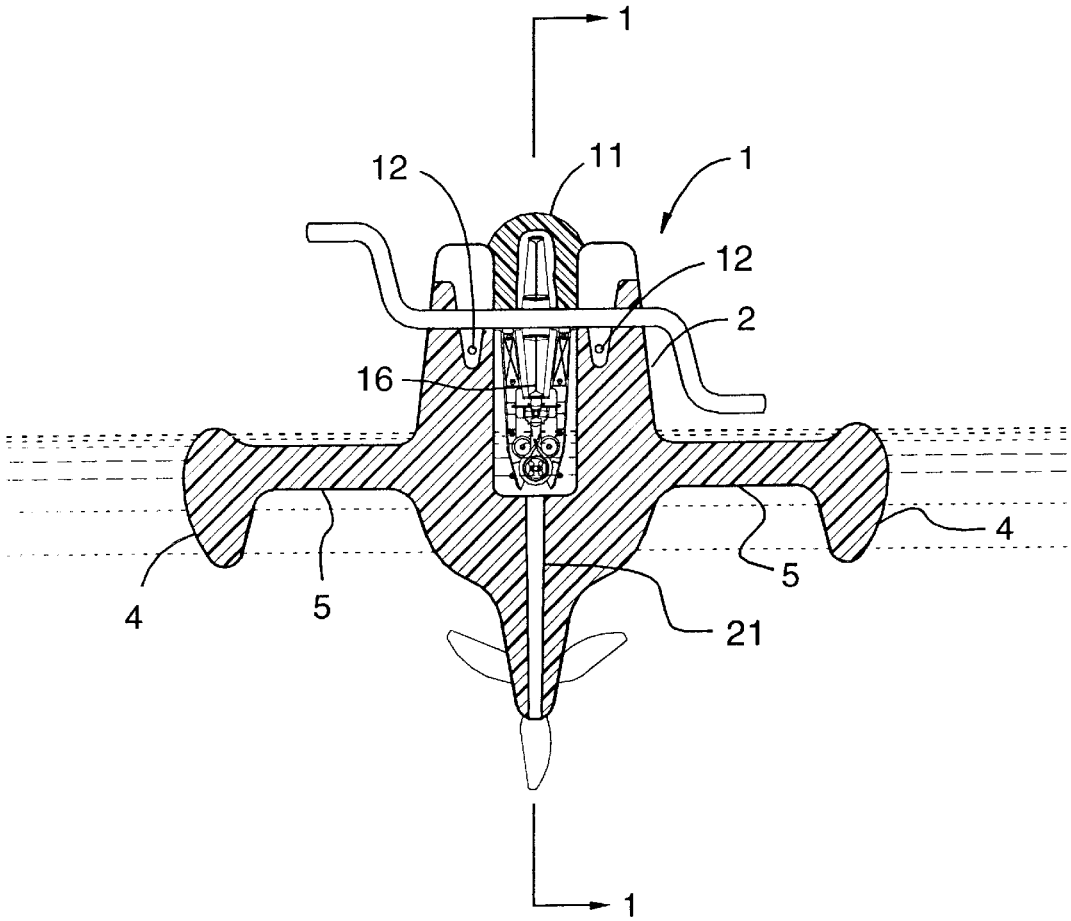
FIG. 2 is transverse cross sectional view along lines 2—2 of FIG. 1 illustrating the cross sectional shape of the hull with lateral outriggers, partially water filled sump and central body with downwardly extended keel.

FIG. 1 shows a longitudinal sectional view through the aquatic vehicle immersed in water. As shown in FIG. 2, the hull 1 includes an elongate central hull body 2 with a saddle seat 3 disposed on an upper surface of the body 2 for straddling the hull body 2 by the passenger. The hull 1 includes two elongate outriggers 4 disposed laterally outwardly from the hull body 2 with outrigger arms 5 connecting the body 2 to the outriggers 4. The outriggers 4 provide lateral stability and enable the passenger to bank the vehicle on curves. The outrigger arms 5 also provide a resting position for the feet of the passenger. The entire hull 1 can be formed as a hollow hull by plastic blow moulding processes well known to those skilled in the art. If desired the hull 1 can be filled with foam for improved leak resistance.

Figure 3:
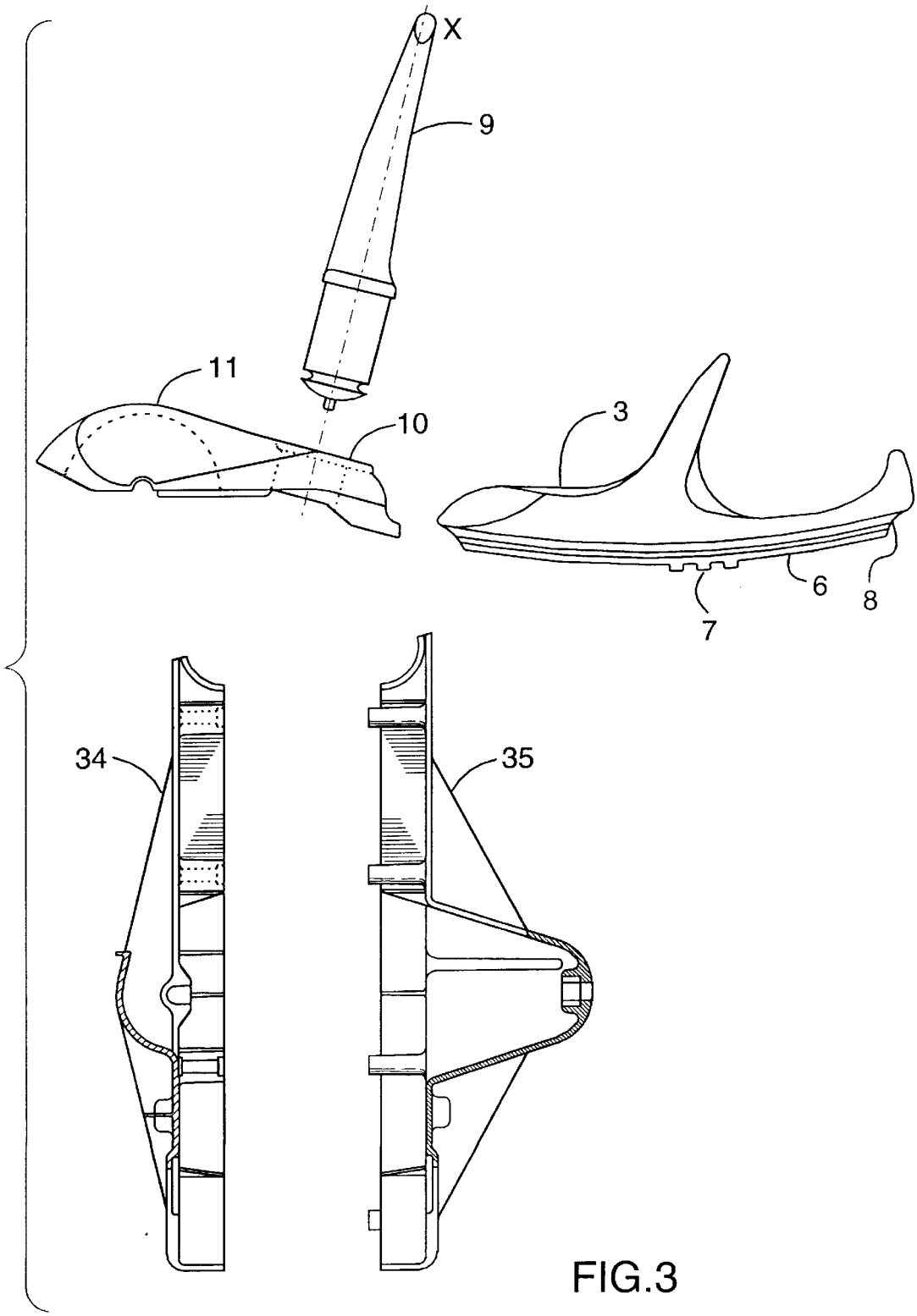
FIG. 3 is an exploded view of vehicle components showing the saddle seat with arcuate lower edge and teeth for position adjustment, the T-bar steering column which inserts into the blow moulded cover over the sump and the flywheel, and illustrating the split drive mechanism housing.

With reference to FIG. 3, the saddle seat 3 has an arcuate lower surface 6, which engages a mating arcuate surface on the hull body 2. The seat 3 and body 2 include interlocking teeth 7 for adjusting the position of the seat 6 relative to the body 2 on an arcuate path. The body 2 and seat 3 also include longitudinal interlocking tongue and groove means 8 to prevent the seat 3 from becoming unintentionally disengaged from the body 2.

A blow moulded hollow T-bar steering handle 9 is journaled for rotation in an opening 10 in a plastic sump/flywheel cap 11. With reference to FIG. 1, the steering handle 9 is secured to cords 12 disposed in a groove in the body (shown in FIG. 2) to rotate the rudder 13.

Figure 9:
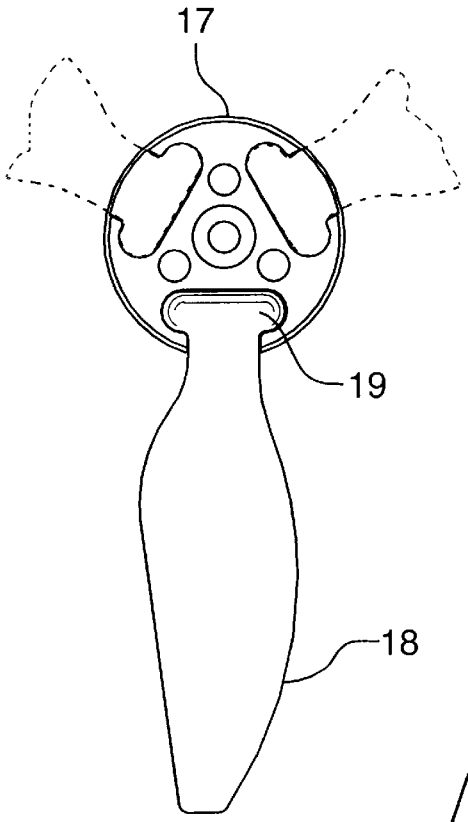
FIGS. 9 and 10 are respectively a transverse sectional and longitudinal sectional view through the folding propeller hub and blades showing the blades in solid outline in the open position and in the dotted outline in the rotated closed position.
Figure 10:
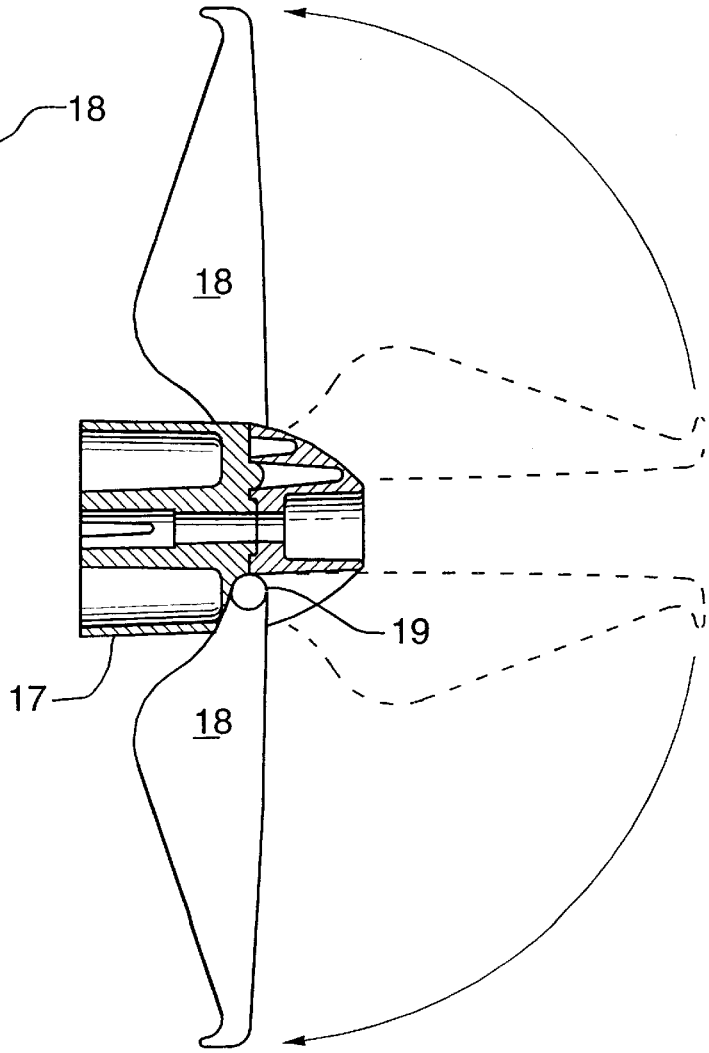

With reference to FIGS. 1, 9, and 10, the propeller 14 is rotated by a shaft 15 driven by a pedal powered drive mechanism 16 (described below in detail). As best shown in FIGS. 9 and 10, the propeller has a central hub 17 with three blades 18 that rotate between an open position (shown in FIG. 10) transverse to the hub 17 and a closed position (shown in FIG. 1 and in dotted outline in FIG. 10) wherein the blades 18 extend rearwardly. It will be understood therefore that when the hub 17 is rotated rapidly, the centrifugal force exerted on the blades 18 force the blades 18 to the open position. The blades 18 have an inward transverse cylindrical end 19 which permits free rotation of the blades 18 in the hub assembly 17. The advantages include the ability of the propeller to fold and avoid damage when the aquatic vehicle is dragged on shore or encounters underwater obstacles. As well, the folding of the blades 18 permit the passenger to cease pedaling without disengaging their feet from the pedals. Water flowing passing over an open propeller would exert an undesirable torque on the propeller which may force the pedal cranks to disengage the passenger's feet or may overstress the plastic propeller, shaft and drive mechanism. The folding propeller therefore renders the vehicle drive mechanism more resistant to damage from flowing water, underwater obstacles, and abrasion damage on shore.

Figure 4:
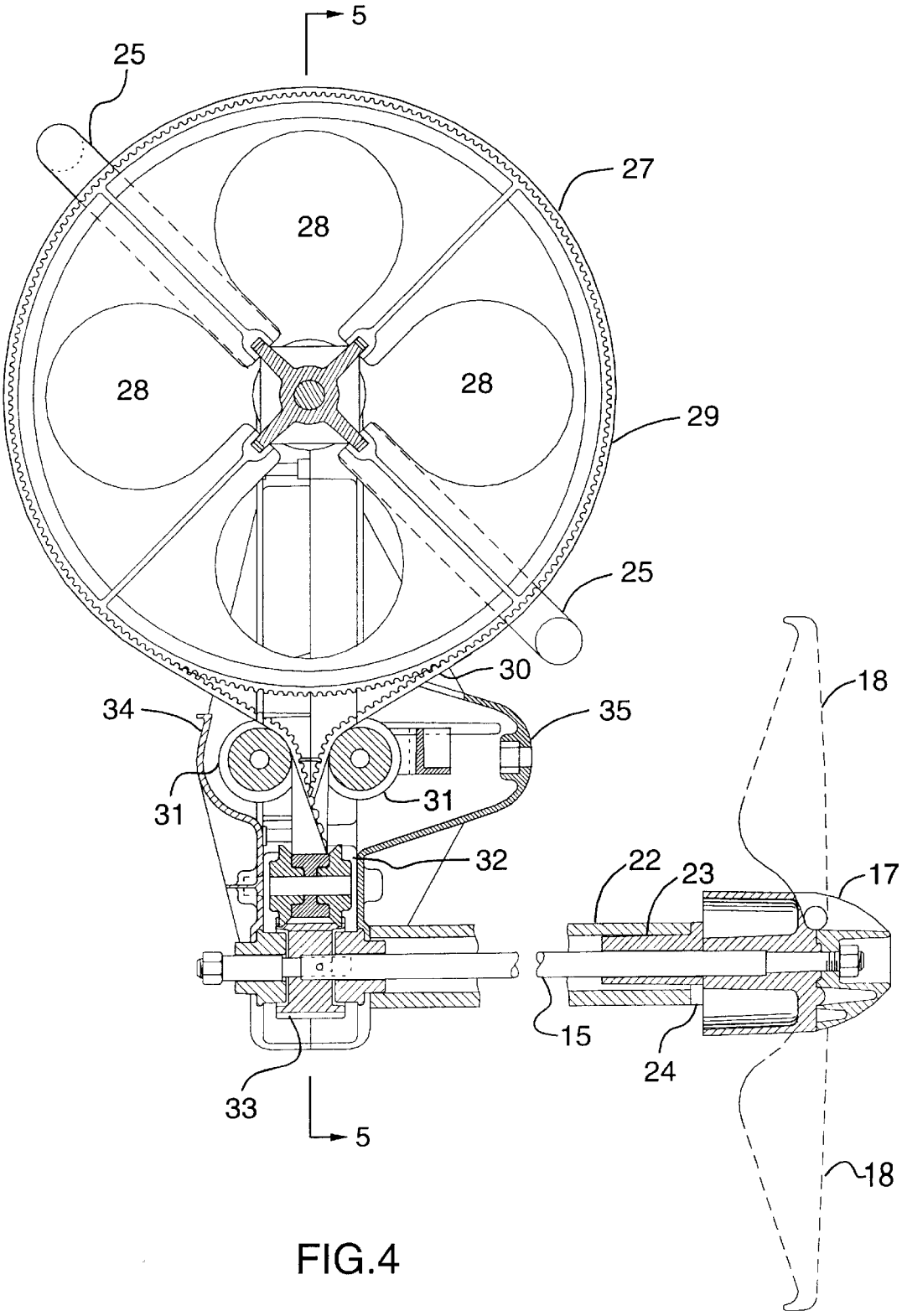
FIG. 4 is a longitudinal cross-sectional view through the pedal powered drive mechanism showing from top to bottom: the pedal cranks and flywheel mounted transversely: drive belt extending passed idlers to twist 90° and engage a final disc mounted to the forward end of the drive shaft to drive the folding propeller at the rearward end of the drive shaft.
Figure 5:
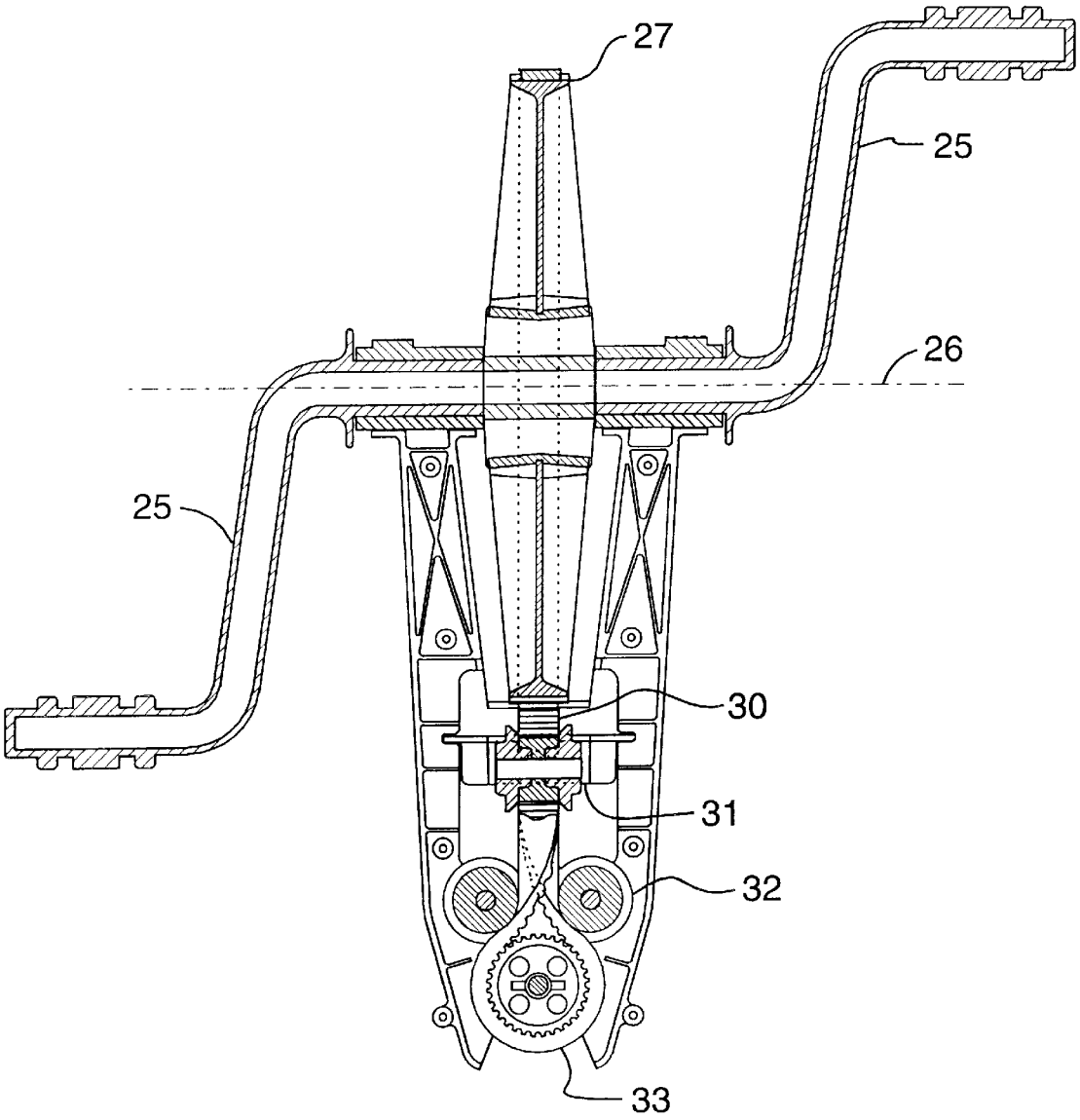
FIG. 5 is a transverse cross-sectional view along line 5—5 of FIG. 4.

Referring to FIGS. 4 and 5, the aquatic vehicle includes novel pedal powered drive means 16 which in the embodiment illustrated is housed within a sump 20 covered with a cap 11. The sump 20 is a hollow cavity formed within the body 2 which includes a water inlet 21, that is disposed to flood a lower portion of the sump with water when the hull is immersed in water. The flooding of the lower portion of the sump provides water for splash cooling of the drive means 16 as will be described in detail later. The sump 20 also includes an outlet to drain the lower portion of the sump 20. In the embodiment illustrated the sump water outlet is a sleeve 22 spaced a distance above the shaft 15 extending from the sump 22 to the propeller 14. As best shown in FIG. 4, the propeller bearing 23 fits within the sleeve 22 and on its lower side includes a slot cutout 24 which provides a drain hole for draining water from the sleeve 22 and sump 20.

As shown in FIGS. 4 and 5 the pedal powered drive mechanism includes a pair of pedal cranks 25 journaled for rotation about a transverse axis 26 and transmission means mounted on a forward end of the drive shaft 15 for rotating the shaft 15 in response to rotation to the cranks 25. Advantageously, the transmission means includes a flywheel 27 preferably moulded of plastic with metal weights 28 to provide the desired inertia. In the embodiment illustrated, the flywheel includes teeth 29 on its periphery to engage a toothed drive belt 30. The drive belt 30 runs over idler rollers 31 and 32 that serve to twist the drive belt 30 through an angle of 90° to engage a final drive disc 33 mounted on the inward end of the longitudinal shaft 15. Support for these components is provided by a split housing preferably formed of moulded plastic with a forward portion 34 and a rearward portion 35 shown in exploded view in FIG. 3.

Figure 6:
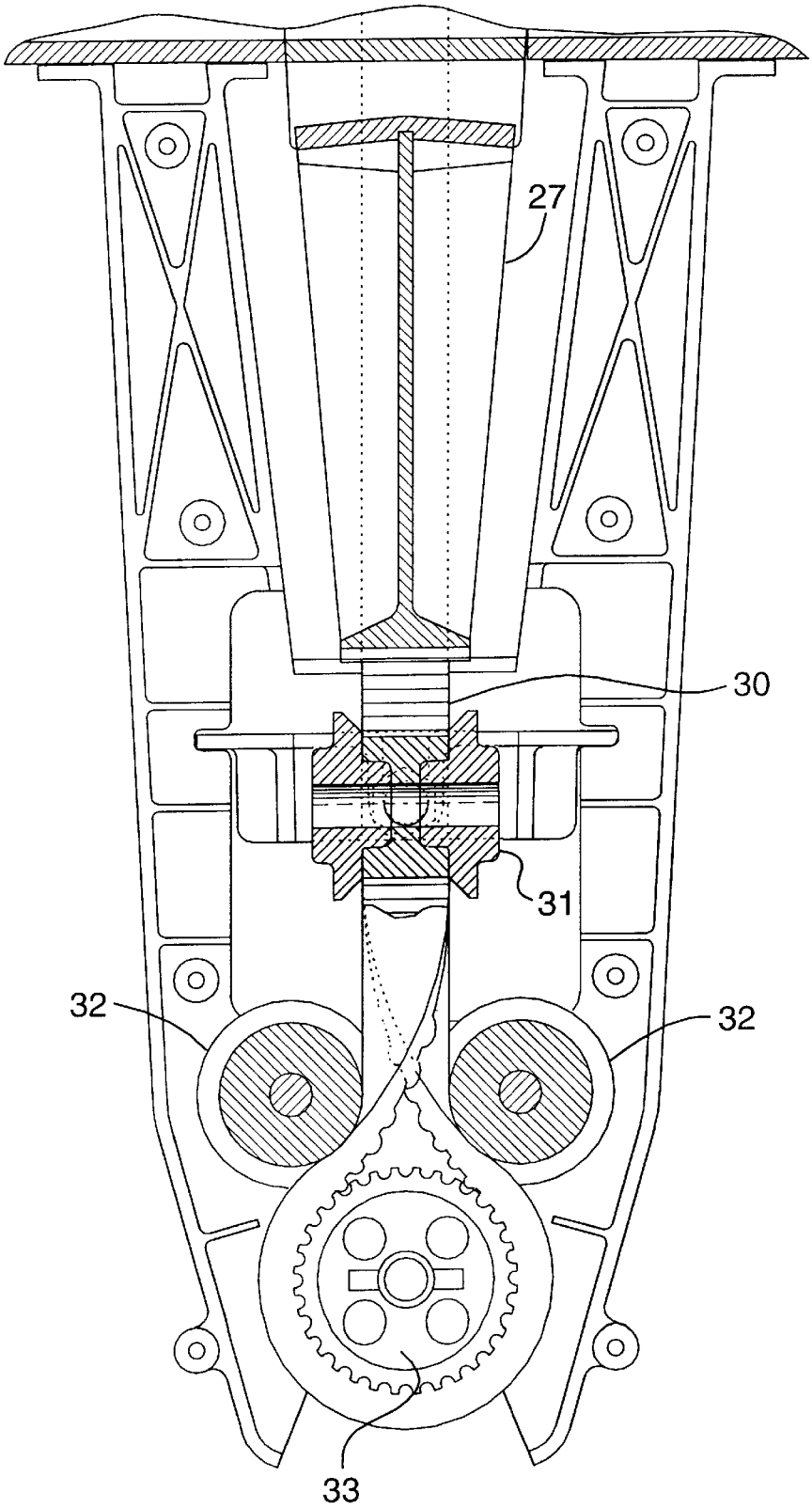
FIG. 6 is a detailed view of the twisting of the drive belt in a transverse cross-sectional view similar to FIG. 5.

Preferably, the drive belt 30 is of the type similar of the timing chain of an automobile engine that includes semi cylindrical ridges for accurate power transmission and avoidance of slippage. As best illustrated in FIG. 6, the use of a flexible drive belt 30 with transversely oriented idlers 31 and 32 enables a simple drive mechanism to be provided where the belt is twisted between the flywheel 27 and final disc 33. This simple mechanism avoids the complexity of gear reduction and power losses resulting from use of conventional meshed gear transmissions. As well, the entire assembly can be economically constructed of robust plastic components that are accurately and inexpensively moulded.

Water-cooling is provided by immersing the disc 33 and a lower portion of the drive belt 30 in the water which floods into the lower portion of the sump 20. The motion of the belt 30 and disc 33 splashes water for cooling within the interior of the housing 34, 35 and circulates water within the sump 20 enclosed by the walls of the sump 20 formed in the body 2 and the sump/flywheel cover cap 11. Water drawn in to the plastic housing 34, 35 splashes over the moving parts of the mechanism and is contained within the cap 11 and sump 20 preferably for exit through the sleeve 22 as the vehicle glides over the water surface.

Figure 7:
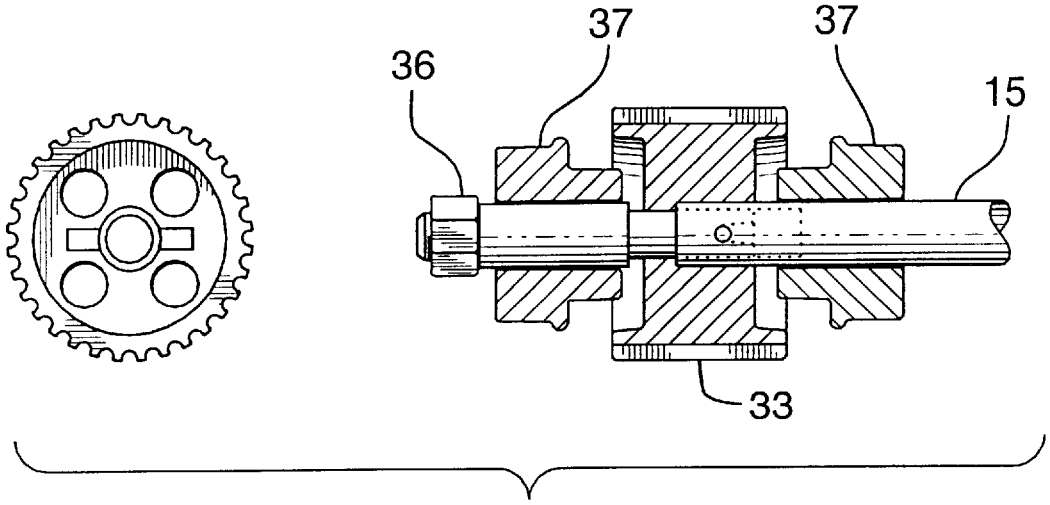
FIG. 7 is an exploded view of the final drive sprocket disc mounted to the forward end of the shaft.

Referring to FIG. 7, the final disc 33 is mounted to the forward end of the shaft 15 with a simple threaded nut 36 clamped between forward and rearward clamping rings 37.

Figure 8:
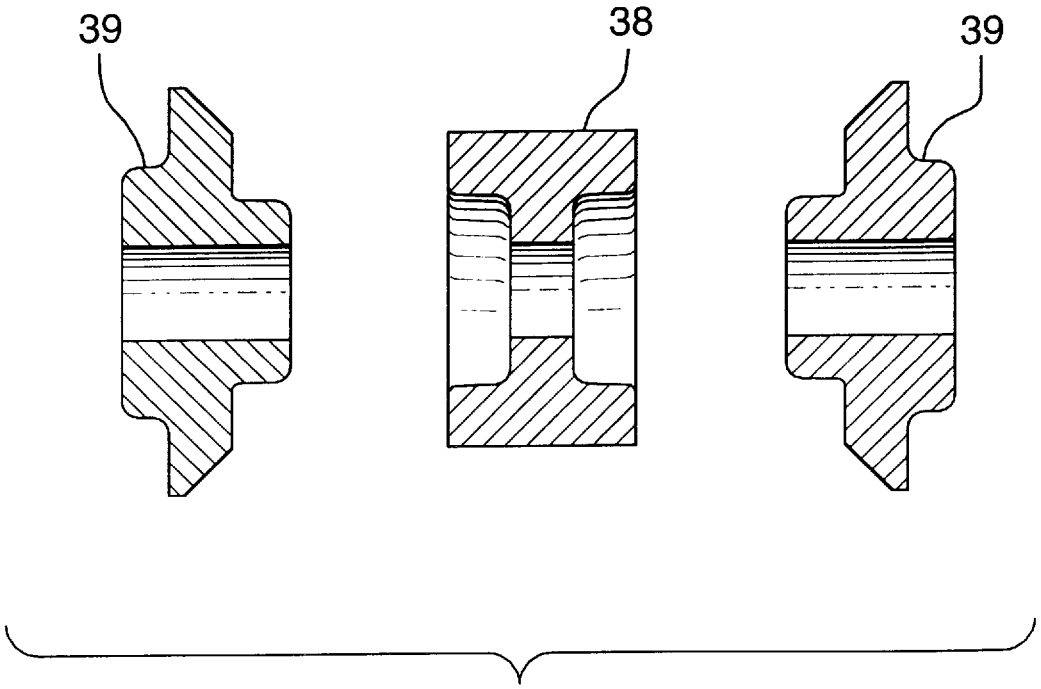
FIG. 8 is an exploded view of the idler rollers illustrating the central roller and two outer flange rollers mounted for independent coaxial rotation on a common idler axial.

Refering to FIG. 8, the idler rollers 31 and 32 each include a central roller 38 and two outer-flanged rollers 39. The central roller 38 and flange rollers 39 are each mounted for independent co-axial rotation on a common idler axial. The primary function of the central roller 38 is to engage the wide outer surface of the belt 30 as the belt 30 engages and disengages the flywheel 27 and disc 33. The flanged rollers 39 engage the lateral edges of the belt 30 and maintain alignment especially as required during the twisting of the belt 30 as shown in FIG. 6. Where the belt 30 is twisted, the idlers 31, 32 ensure that engagement and disengagement from the flywheel 27 and disc 33 is maintained in proper alignment. Without the flanged rollers 39 of the idlers 31 and 32, the edges of the belt 30 would tend to wander and improper alignment of the ridges in the belt 30 and grooves in the sprockets would result in excessive wear and belt damage.

As described above therefore, the water-cooled drive mechanism can be simply constructed of moulded plastic components in an economical manner. The drive mechanism is extremely simple to manufacture and maintained thereby overcoming the major impediment to providing an practical pedal-powered propeller-driven aquatic vehicle.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. An aquatic vehicle comprising:

a buoyant hull with a central longitudinal axis and rider means for supporting a passenger;

steering means mounted to the hull for manual steering by the passenger;

pedal powered drive means mounted to the hull for driving a stern mounted propeller, wherein the hull includes a sump for housing the drive means partially immersed in cooling water, the sump including a water inlet disposed to flood a lower portion of the sump when the hull is immersed in water.

2. An aquatic vehicle according to claim 1 wherein the pedal powered drive means comprise: a pair of pedal cranks journaled for rotation about a transverse axis; a longitudinal drive shaft with the propeller mounted on a rear end and transmission means mounted on a forward end for rotating the shaft in response to rotation of the cranks.

3. An aquatic vehicle according to claim 1 wherein the transmission means includes a flywheel.

4. An aquatic vehicle according to claim 1 wherein the transmission means includes a drive belt.

5. An aquatic vehicle according to claim 4 wherein the drive belt engages a periphery of a flywheel and the periphery of a final drive disc mounted co-axially on the longitudinal shaft.

6. An aquatic vehicle according to claim 5 wherein the flywheel is journaled for rotation about a transverse axis and wherein the drive belt is twisted by a 90° angle between the flywheel and disc.

7. An aquatic vehicle according to claim 6 wherein the transmission means includes idler rollers engaging the drive belt between the flywheel and disc.

8. An aquatic vehicle according to claim 7 wherein the idler rollers include a central roller and two outer flanged rollers, each mounted for independent coaxial rotation on a common idler axle.

9. An aquatic vehicle according to claim 5 wherein the drive belt, flywheel and disc each include mating toothed surfaces.

10. An aquatic vehicle according to claim 1 wherein the sump includes a water outlet disposed to drain a lower portion of the sump.

11. An aquatic vehicle according to claim 10 wherein the drive means include a longitudinal shaft extending from the sump to the propeller, and wherein the hull includes a sleeve spaced a distance about the shaft, the sleeve including a drain hole at a lower stern end thereof.

12. An aquatic vehicle according to claim 1 wherein the propeller includes: a central hub and a plurality of blades pivotally mounted to the hub for rotation between an position extending transverse to the hub and a closed position extending rearwardly.

13. An aquatic vehicle according to claim 1 wherein the hull includes an elongate central hull body with saddle seat means disposed on an upper surface of the body for straddling the hull body by the passenger.

14. An aquatic vehicle according to claim 13 wherein the hull includes two elongate outriggers disposed laterally from the hull body with outrigger arms connecting the body to the outriggers.

15. An aquatic vehicle according to claim 13 wherein the saddle seat has an arcuate base in longitudinal sliding engagement with a mating arcuate surface on the hull body, the seat and body including locking means for adjusting the position of the seat relative to the body on an arcuate path.

16. An aquatic vehicle according to claim 15 wherein the locking means comprise interlocking teeth on the mating arcuate surfaces in the seat and body.

* * * * *